United States Patent [19]

Weissler, II et al.

[11] Patent Number: 4,986,243

[45] Date of Patent: Jan. 22, 1991

[54] MASS AIR FLOW ENGINE CONTROL SYSTEM WITH MASS AIR EVENT INTEGRATOR

[75] Inventors: Harold E. Weissler, II, Newport News; Benjamin G. Shirey, Hampton, both of Va.

[73] Assignee: Siemens Automotive L.P., Troy, Mich.

[21] Appl. No.: 467,823

[22] Filed: Jan. 19, 1990

[51] Int. Cl.[5] ..... F02M 51/00

[52] U.S. Cl. ..... 123/488; 123/492; 123/422

[58] Field of Search ..... 123/488, 492, 422, 428, 123/494; 364/431.05; 73/118.2

[56] References Cited

U.S. PATENT DOCUMENTS

| | | | |
|---|---|---|---|
| 4,747,387 | 5/1988 | Takao et al. | 123/494 |
| 4,814,997 | 3/1989 | Matsumura et al. | 364/431.05 |
| 4,844,042 | 7/1989 | Osano | 123/492 |
| 4,911,128 | 3/1990 | Nara et al. | 123/488 |
| 4,917,067 | 4/1990 | Yoshida | 123/488 |

*Primary Examiner*—Raymond A. Nelli

*Attorney, Agent, or Firm*—George L. Boller; Russel C. Wells

[57] ABSTRACT

In an internal combustion engine control system, an electronic circuit accepts a non-linear analog signal from a Mass Air Flow (MAF) sensor and converts it to a digital signal by means of a linear or non-linear analog to digital (A/D) converter. The digital signal is then processed by a two-dimensional look-up table which includes corrections for the MAF sensor non-linearity and additional corrections for non-linearity of the A/D converter. This linearized MAF signal is then integrated or averaged to provide air mass per engine event or average mass air flow during an event. This circuit is useful in obtaining better accuracy in fuel management systems that use MAF sensors, particularly if variable valve control is included as part of the control system. The look up table and integrator can be easily implemented in a digital signal processor or microcontroller. The integrated or averaged MAF value can be used to control the various functions of the internal combustion engine in conjunction with other inputs (e.g., coolant level, engine speed or period, throttle position, etc.). An engine load factor representing the trapped mass or air in the combustion chamber is calculated by multiplying the MAF signal by the engine period. The load factor may be used to program ignition timing, control the air and fuel delivery systems, etc.

21 Claims, 6 Drawing Sheets

FIG. 5
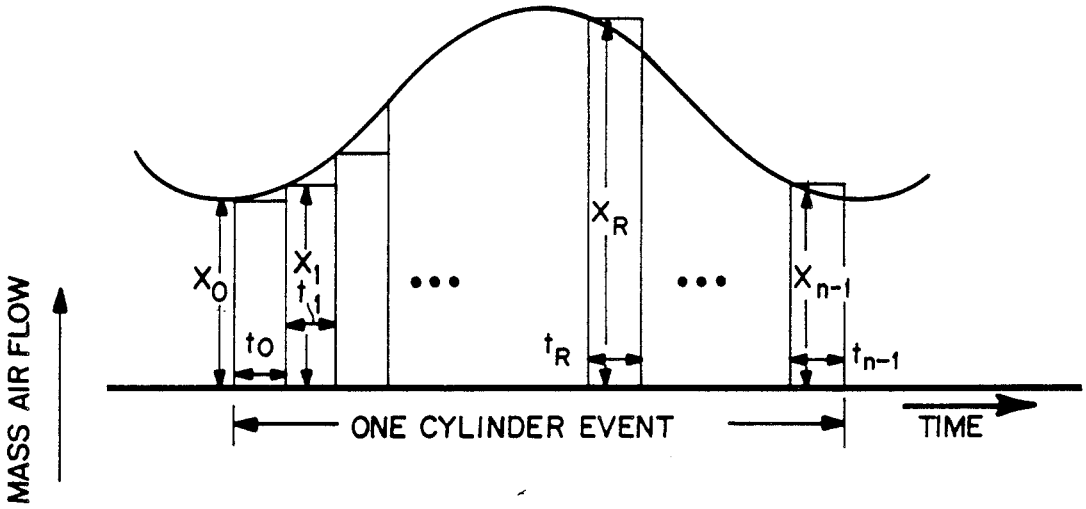
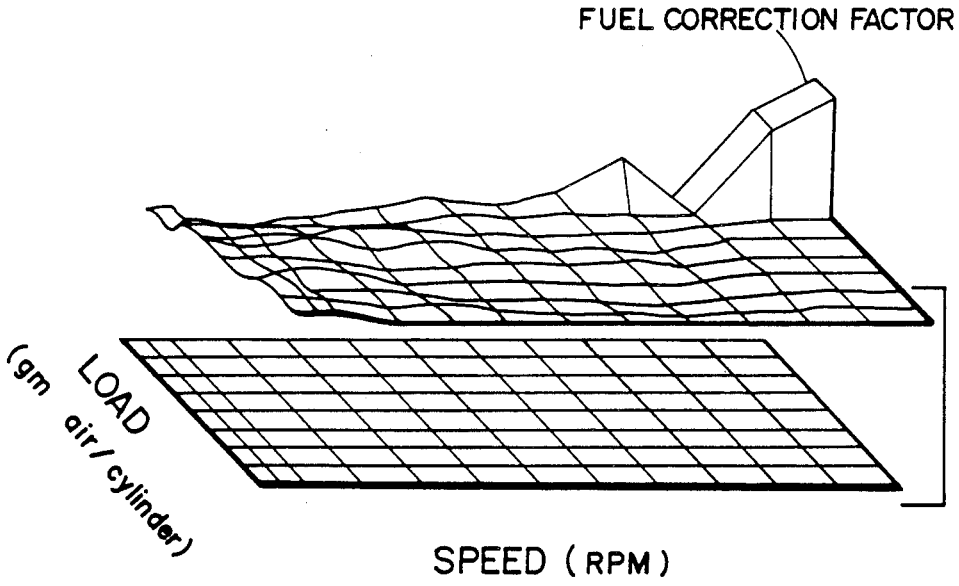
FIG. 6

MASS AIR FLOW ENGINE CONTROL SYSTEM WITH MASS AIR EVENT INTEGRATOR

FIELD OF THE INVENTION

The present invention relates to electronic engine control systems, and more particularly to internal combustion engine control systems using mass air sensors. Still more particularly, the present invention relates to techniques for accurately adapting engine control parameters in response to integrated mass air flow corresponding to engine cylinder events.

BACKGROUND AND SUMMARY OF THE INVENTION

Using mass air flow to provide a control input to an electronic engine control system ("ECS") is well known, as is evidenced by the following listing of exemplary prior issued commonly-assigned U.S. patents generally relating to electronic engine control arrangements:

U.S. Pat. No. 4,421,089
U.S. Pat. No. 4,401,063
U.S. Pat. No. 4,387,602
U.S. Pat. No. 4,250,842
U.S. Pat. No. 4,246,639
U.S. Pat. No. 4,245,317
U.S. Pat. No. 4,228,777
U S. Pat. No. 4,214,307
U S. Pat. No. 4,212,065
U S. Pat. No. 4,193,380
U S. Pat. No. 4,186,602
U S. Pat. No. 4,096,833
U S. Pat. No. 4,096,831
U S. Pat. No. 4,091,773.

The following additional patents also relate to air flow sensing arrangements within electronic engine control systems:

U.S. Pat. No. 4,860,222
U.S. Pat. No. 4,587,884
U.S. Pat. No. 4,448,070
U.S. Pat. No. 4,494,405
U.S. Pat. No. 4,445,369
U.S. Pat. No. 4,433,576
U.S. Pat. No. 4,125,093
U.S. Pat. No. 4,425,886
U.S. Pat. No. 4,403,506
U.S. Pat. No. 4,317,365
U.S. Pat. No. 4,237,830
U.S. Pat. No. 4,083,244
U.S. Pat. No. 3,433,069
U.S. Pat. No. 3,374,673

As is well known, mass air flow parameters are extremely useful in controlling the operation of an internal combustion engine. Mass air flow relates to the mass of the air actually flowing through (into) the engine, and thus provides information useful in calculating and controlling critical engine operating parameters such as air-fuel ratio. One of the advantages of measuring mass air flow directly using, for example, a mass air flow meter (as opposed to indirectly using an air volume flow meter) is independence of the measurement on variables such as engine tolerances (which may change as the engine wears). See, for example, Loesing et al, "Mass Air Flow Meter—Design and Application", *SAE Technical Paper Series* No. 890779 (International Congress and Exposition, Detroit, Mich., Feb. 27–Mar. 3 1989).

Typical conventional mass air flow meters found in many of today's automotive systems operate on the hot wire anemometer principle. Briefly, a hot film or wire is heated by an electrical current so as to maintain a constant temperature differential between the heated element and another non-heated (i.e., at ambient temperature) element. The air flowing past the heated element removes heat from that element (with higher mass air flow removing more heat)—requiring additional electrical heating current to maintain the heated element at the constant temperature differential above ambient. A voltage differential $V_{out}$ appearing across a resistor coupled (typically in series) with the heating element is measured or otherwise used to provide a direct measure of mass air flow.

As is well known, this hot wire anemometer type mass air flow sensor provides mass air flow as a fourth order function of the voltage output signal:

$$V_{out} = k_1 \sqrt[4]{m_L} + k_2$$

where $V_{out}$ is the output voltage, $k_1$ and $k_2$ are constants, and $m_L$ is the mass air flow. FIG. 1 shows a typical transfer function for an exemplary hot wire anemometer type mass air flow sensor showing this fourth-order relationship.

One problem arises as to how to efficiently obtain the mass air flow from the sensor $V_{out}$ output without introducing errors or using costly components.

In automotive fuel management systems, it is desirable to calculate or estimate the mass of air taken into a corresponding individual combustion chamber cylinder during the intake stroke (in a Otto cycle type four-stroke internal combustion engine for example) in order to determine the amount of fuel that must be injected into that cylinder so as to provide a desired air/fuel ratio. Unfortunately, the air flow is anything but constant over an engine cycle, but rather may be more accurately thought of as surges or pulses of air flowing into the cylinder during the time the intake valve is open.

One technique used in the past to determine the air mass flowing into a cylinder during the intake stroke is to apply a wave form factor to the sampled air flow value. However, this technique is generally successful only if the wave shape is constant and the sample location on the wave form is known. Neither of these conditions exist in modern engines including variable valve timing. Variable valve timing control can add large variations to the mass air flow during an engine cycle. The wave shapes of these variations are not predictable, and wave shape factor and/or synchronous sampling techniques are therefore not effective to provide accurate mass air flow determinations based on more limited measurement information. To obtain the air "charge" (trapped air mass) in a cylinder combustion chamber under these circumstances, the air flow may be integrated (e.g., with respect to time) for each cylinder "event" (e.g., intake stroke) using a sufficiently large number of sufficiently high resolution samples to yield an accurate air mass determination.

One attempt to filter (integrate) the flow signal using analog circuitry introduced large errors attributable to the non-linear nature of the $V_{out}$ signal. Difficulties with this method can be demonstrated by providing a somewhat simplified but nevertheless illustrative example.

The following Table I provides the transform for a typical mass air flow sensor:

TABLE I

| Sensor Calibration | |
|---|---|
| Mass Air Flow kg/hr X | Sensor Voltage Y |
| 13.0000 | 0.48500 |
| 15.00000 | 0.55500 |
| 20.00000 | 0.71700 |
| 25.00000 | 0.84200 |
| 30.00000 | 0.94000 |
| 35.00000 | 1.02400 |
| 40.00000 | 1.10400 |
| 45.00000 | 1.18200 |
| 50.00000 | 1.25600 |
| 60.00000 | 1.39400 |
| 70.00000 | 1.52000 |
| 80.00000 | 1.63500 |
| 90.00000 | 1.74100 |
| 100.00000 | 1.83900 |
| 110:00000 | 1.92900 |
| 130.00000 | 2.09400 |
| 150.00000 | 2.24000 |
| 160.00000 | 2.30800 |
| 170.00000 | 2.37200 |
| 180.00000 | 2.43500 |
| 190.00000 | 2.49400 |
| 200.00000 | 2.55300 |
| 210.00000 | 2.60900 |
| 230.00000 | 2.71500 |
| 250.00000 | 2.81200 |
| 270.00000 | 2.90900 |
| 300.00000 | 3.04400 |
| 350.00000 | 3.25200 |
| 400.00000 | 3.44200 |
| 450.00000 | 3.61500 |
| 500.00000 | 3.77600 |
| 550.00000 | 3.92900 |
| 600.00000 | 4.07300 |
| 650.00000 | 4.20900 |
| 700.00000 | 4.33600 |
| 750.00000 | 4.45800 |
| 850.00000 | 4.69200 |

The left-hand (X) column sets forth mass air flow in kg/hour, and the right-hand (Y) column indicates the corresponding mass air flow sensor output voltage $V_{out}$ (in volts) for an exemplary mass air flow sensor.

Assume for purposes of this example a simplified combustion cylinder air intake waveform in which the flow is 600 kg/hr for ½ second and then drops to 30 kg/hr for ½ second. The correct average (integrated) value of mass air flow during the one second sample period would then be given by:

$$(600\ kg/hr * 0.5\ seconds) + (30\ kg/hr * 0.5\ seconds) = 315\ kg/hr * sec.$$

If the corresponding voltages $V_{out}$ from Table I are referenced, it will be seen that 600 kg/hr corresponds to an output voltage $V_{out}$ of 4.073 V, and 30 kg/hr corresponds to a sensor output voltage $V_{out}$ of 0.940 V.

Integrating these voltages $V_{out}$ over time yields the following result:

$$(4.073\ V * 0.5\ sec) + (0.940\ V * 0.5\ sec) = 2.507\ volts\ sec.$$

From Table I (using interpolation), 2.506 volts corresponds to only 193 kg/hr! This represents an error of 39% with respect to the actual value of 313 kg/hr. FIG. 2 shows these values superimposed on the exemplary sensor transfer function curve shown in FIG. 1. The error arises because of the non-linear nature of the $V_{out}$ signal. Accordingly, it is desirable to linearize the signal so as to eliminate non-linearity.

It is generally known to linearize a non-linear analog signal by converting the non-linear signal to a digital value and to then map or convert (e.g., using a look-up table stored in a read only memory device) the resulting digital value into a linearized value. Unfortunately, when the $V_{out}$ signal from a mass air flow sensor is converted to the digital domain for subsequent digital processing, special attention to accuracy of the lower end of the scale is required to obtain adequate resolution due to the fourth-order characteristic of the sensor transfer function (see the "crowding" of points on the portions of the FIG. 1 curves corresponding to flows less than 250 kg/hour, for example). Thus, a high cost, higher resolution digital-to-analog (D/A) converter is typically required to obtain the resolution required (even though the higher resolution is really only required on the lower end of the scale).

The present invention provides an improved electronic internal combustion engine control system and technique which more effectively utilize measured mass air flow.

In accordance with one feature of the invention, a lower cost non-linear A/D converter (e.g., of the type commonly used in the communications field) can be used to convert an analog output signal produced by a mass air flow sensor into a digital signal. Such A/D converters offer higher resolution at lower cost, but also introduce further non-linearities into an already non-linear signal. In accordance with this feature of the present invention, the digital output of the A/D converter is applied to a look-up table (e.g., implemented by a ROM storing predetermined mapping information) containing linearizing information at each memory location. The linearizing information is defined by the combined functions of: (a) conversion to linearize the output of the mass air flow sensor, and (b) further conversion to eliminate the non-linearities introduced by the non-linear A/D converter. Thus, the two functions required to obtain a linear digital signal can be combined into a single look-up table—saving resources (memory and time) in the processing of the digital signal.

An electronic circuit thus accepts a non-linear analog signal from a Mass Air Flow (MAF) sensor and converts it to a digital signal by means of a linear or non-linear analog to digital (A/D) converter. The digital signal may then be processed by a two-dimensional look-up table which includes corrections for the MAF sensor non-linearity and additional corrections for non-linearity of the A/D converter. This linearized MAF signal is then integrated or averaged to provide air mass per engine event or average mass air flow during an event. This circuit is useful in obtaining better accuracy in fuel management systems that use MAF sensors, particularly if variable valve control is included as part of the control system. The look-up table and integrator can be easily implemented in a digital signal processor or microcontroller.

Digital linearized flow is thus integrated in the preferred embodiment of the present invention by summing samples taken at regular fixed engine positions, and by dividing by the number of samples to obtain average flow over the cycle. Alternatively, the sample may be multiplied by the time between samples and summed to obtain total air mass for the cycle. If total mass per cycle is desired and the sampling rate is constant rate (not fixed engine degrees), then the samples can be summed over the cycle and the resulting sum may be multiplied by the fixed sampling time (thereby saving a multiplication per sample).

The present invention also provides an improved technique for accurately controlling various functions of an internal combustion engine using electronically measured mass air flow into the engine. A microprocessor based electronic control unit (ECU) may receive input signals from a mass air flow sensor (MAFS) as well as other engine operating parameters (e.g., engine speed or period, coolant temperature, throttle position, etc.). An engine load factor (representing the trapped mass of air in a given combustion chamber) is calculated by multiplying the MAFS signal with the engine period. This load factor better utilizes the MAFS output—giving a result similar to the commonly used manifold pressure without the need for such a special sensor. The load factor may then be used to program spark timing, correct the fuel pulse width, program idle/deceleration air, program acceleration enrichment/deceleration enleanment and deceleration fuel cutoff, bias closed loop control, and/or other control functions using conventional engine control algorithms.

BRIEF DESCRIPTION OF THE DRAWINGS

These and other features and advantages of the present invention may be better and more completely understood by referring to the following detailed description of a presently preferred exemplary embodiment in conjunction with the sheets of FIGS. of which:

FIG. 5 is a graphical illustration of a further exemplary integration process performed by a preferred embodiment integrator shown in FIG. 3;

FIG. 6 is a graphical illustration of an exemplary three-dimensional plot of a fuel correction factor provided by the preferred embodiment shown in FIG. 3.

DETAILED DESCRIPTION OF THE DRAWINGS

Figure 3:
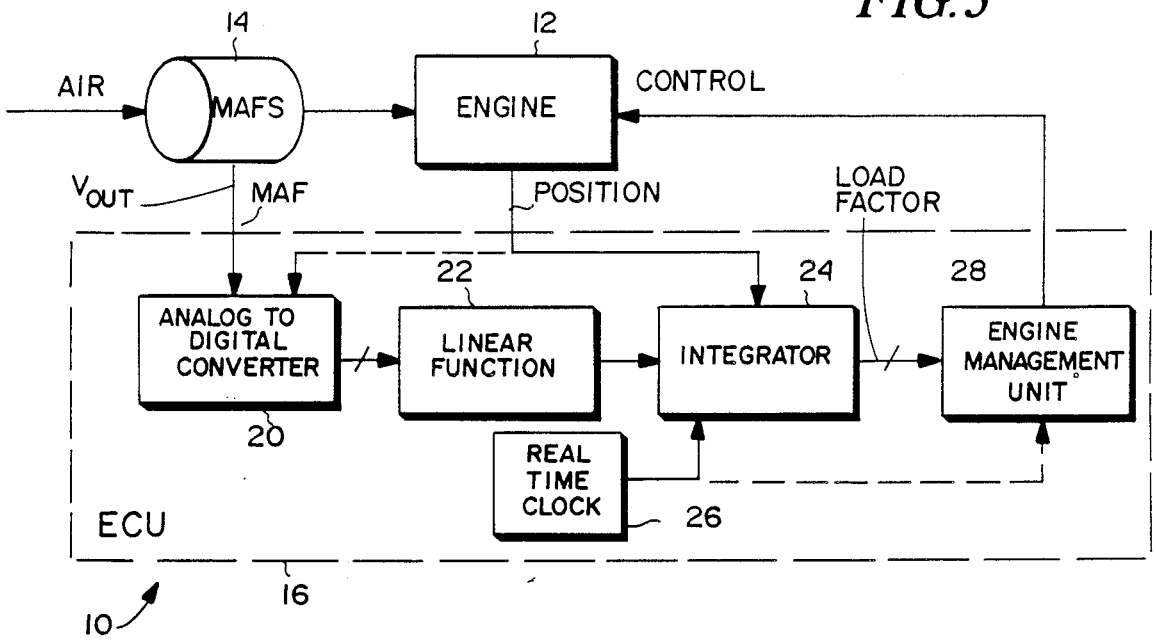
FIG. 3 is a schematic block diagram of an exemplary electronic engine control system in accordance with the presently preferred exemplary embodiment of the present invention.

FIG. 3 is a detailed schematic block diagram of a presently preferred exemplary embodiment of an internal combustion engine system 10 in accordance with the present invention. Engine system 10 includes a conventional internal combustion engine 12 and associated support components (the combination of the engine 12 and its support components is referred to herein as "the engine system 10"). Engine 12 may include a plurality of cylinders each having an associated piston. The pistons reciprocate in response to rotation of the engine crankshaft, as is well known. Intake and exhaust valves also coupled to the crankshaft (e.g., via a camshaft) open and close at predetermined crankshaft rotation positions as is well known.

A mass air flow meter or sensor (MAFS) 14 is conventionally disposed (e.g., within an intake manifold or passage, throttle body, or the like) to measure the instantaneous mass of air flowing into engine 12. MAFS 14 produces an output signal $V_{out}$ indicative of the mass of air flowing into the engine. MAFS 14 provides signal $V_{out}$ to an electronic engine control unit (ECU) 16, which processes the signal and generates engine control signals in response to the $V_{out}$ signal. Such engine control signals may, for example, control the fuel injector system (not shown) of engine 12 to deliver fuel to the engine cylinders in appropriate amounts (e.g., for appropriate durations).

ECU 16 receives additional input signals relating to the operation of engine 12 such as, for example, an engine position signal indicative of the angular position of the engine crankshaft. This engine position signal may for example be provided by a conventional shaft encoder or magnetic sensor arrangement which produces a pulse each time the engine crankshaft rotates through an additional preset angle (as those skilled in this art well know). This engine position signal may be used in the preferred embodiment to indicate the occurrence and durations of engine events such as cylinder events, as will be explained shortly.

ECU 16 in the preferred embodiment includes an analog-to-digital (A/D) converter 20, a "linear function" block 22, an integrator block 24, a real time clock 26, and an "engine management unit" 28. In one preferred embodiment, A/D converter 20, linear function block 22, and integrator 24 process the MAF signal provided by MAFS 14 and provide a digital value representing "load factor" (e.g., the air "charge" or total mass of air that has flowed into the engine corresponding to a particular engine event such as, for example, the intake stroke of a given engine cylinder).

Engine management unit 28 in the preferred embodiment comprises a conventional (e.g., microprocessor based) digital signal processor appropriately preprogrammed to perform conventional engine management-/control algorithms and to generate and provide engine control signals in accordance with those algorithms. One portion of the conventional engine management-/control algorithm preferably performed by engine management unit 28 in the preferred embodiment involves conventional control of the engine 12 fuel delivery (e.g., fuel injection) system in response to the load factor signal provided by integrator 24. However, as will be understood, the engine control signals provided by engine management unit 28 may control many other engine operating parameters in addition to engine fuel delivery system parameters (and some of these additional engine operating parameters may also be responsive to the "load factor" signal).

In the preferred embodiment, the engine management unit 28 is entirely conventional and performs engine management and fuel delivery control algorithms which are conventional and well known to those skilled in this art. Such conventional engine management and fuel delivery control algorithms may include, for example, control of ignition spark timing, correction of fuel pulse width, control of idle/deceleration air intake, control of acceleration enrichment/deceleration enleanment, providing deceleration fuel cutoff, providing closed loop control bias, and the like as is well known.

Figure 1:
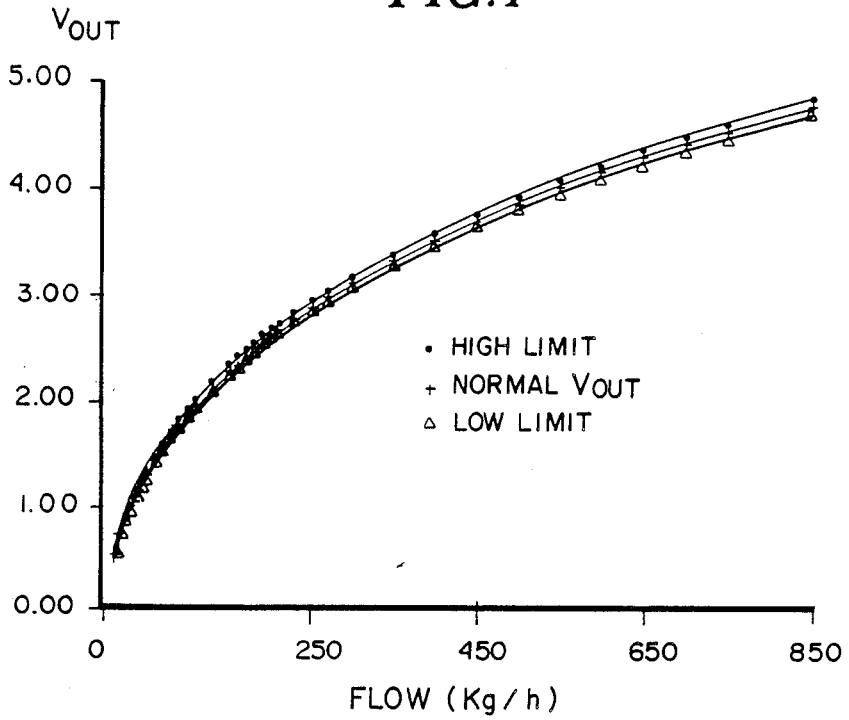
FIG. 1 is a graphical illustration of a typical transfer function of an exemplary mass air flow sensor.
Figure 2:
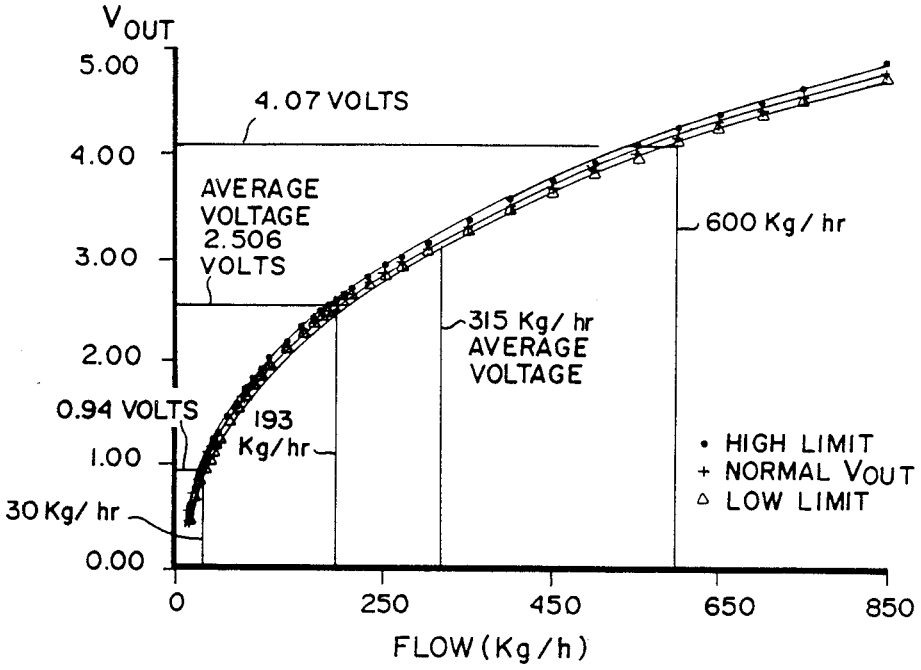
FIG. 2 is a graphical illustration of the results of one analog averaging technique that might be used to process the signal provided by the FIG. 1 transfer function.

In the preferred embodiment, MAFS 14 comprises a conventional hot wire anemometer type mass air flow sensor which provides a voltage output level $V_{out}$ indicative of instantaneous mass air flow. For example, MAFS 14 may have a transfer function of the type shown in FIG. 1 and thereby provide output voltage $V_{out}$ having the following relationship with mass air flow X:

$$X=A(V_{out}-B)^4 \quad (1)$$

where $V_{out}$ is the sensor voltage, A is the sensor gain, and B is the sensor offset voltage (typically nearly constant).

In the preferred embodiment, A/D converter 20 may have a desired sampling rate (which sampling rate may if desired be synchronized with engine rotation in response to the "position" signal provided by engine 12) and resolution (e.g., 8 bits or the like).

To provide additional resolution, it may be desirable to connect two different A/D converters essentially "in parallel" to provide a "low air" digital value and a "high air" digital value. For example, suppose the output voltage range of MAFS 14 is 0–6 volts. This voltage could be multiplied by a factor of 5/6 (e.g., using a conventional precision operational amplifier or similar active or inactive analog circuit having a gain of 5/6) to obtain a 0–5 volt signal, and could also be further multiplied by a factor of 2 to provide a signal 0 to 10 volts, which is then limited to a maximum of 5.00 volts range. When this signal is fed to a 0 to 5.00 A/D converter, the effective resolution of the lower half of the original signal is essentially doubled. These two signals may then each be converted to digital form independently using different conventional A/D converters (one having an input voltage range of 0–5 V and the other having an input voltage range of 0–0.5 V) to provide "low air" and "high air" signals. The "low air" digital signal could be linearized by block 22 for low mass air flow values (e.g., 0–250 cfm in 1023 steps), and the "high air" digital signal could be linearized by block 22 for higher mass air flows (e.g., 0–250 cfm in 255 steps —that is, -1000 cfm in 1023 steps). In this way, two different "ranges" may be provided using off the shelf standard, inexpensive A/D converters (somewhat like standard digital voltmeters provide different voltage "ranges" and provide additional resolution for lower voltage ranges). If desired, both signals may be linearized and presented to integrator block 24, which in turn may integrate both signals independently to provide two different integrated values. The appropriate integrated value (low or high) may then be selected and processed by engine management unit 28 depending upon the magnitude of the mass air flow.

The "linear function" block 22 accepts a digital coded voltage signal from A/D converter 20 and generates a digital signal which represents the linearized mass air flow. In one embodiment, the linear function block 22 comprises a microprocessor (or a time-shared portion of the same microprocessor used to provide digital signal processing within engine management unit 28) appropriately programmed to perform the calculation of the sensor transfer function set forth above ($X=A(V_{out}-B)^4$) and solving for X based on predetermined programmed values for B and A (these values are associated with the particular MAFS 14 used). One advantage of using this calculation is that it requires only one subtraction (to calculate $V_{out}-B$) (see FIG. 9 block 104) and three multiplications (to calculate $(V_{out}-B)^2$, $(V_{out}-B)^3$, and $(V_{out}-B)^4$) (see FIG. 9 block 106), which makes it a very fast calculation to implement and perform using a standard conventional microprocessor, bit slice processor or the like with mathematical calculation capabilities. Implementation of this calculation using an off-the-shelf microprocessor is straight-forward and well within the capabilities of one of ordinary skill in this art.

In an alternate preferred embodiment of the present invention, A/D converter 20 may comprise a conventional non-linear type (e.g., "companding") A/D converter of the type widely used in the communications field and linear function block 22 may comprise a read only memory (ROM) or similar microprocessor or digital signal processor based look-up process. This type of companding A/D converter has good resolution at the lower end of the scale, but introduces an additional (predictable and well-defined) non-linearity into the digitized signal. Linear function block 22 may comprise a read only memory device addressed by the parallel output bits generated by A/D converter and storing predetermined linearizing information specified with regard to both the fourth-order transfer function of the MAFS 14 and the non-linear transfer function of A/D converter 20. In one specific exemplary arrangement, a ROM device would be programmed to store in each of its locations a digital word determined experimentally, empirically and/or by calculation so as to convert the digitized voltage output of A/D converter 20 into a linearized digital value representing mass air flow. TABLE I above sets forth one exemplary set of linearization information that might be combined with additional linearization information corresponding to a particular non-linear A/D converter 20 transfer function to provide the contents for a look-up table referenced by linear function block 22.

Figure 4:
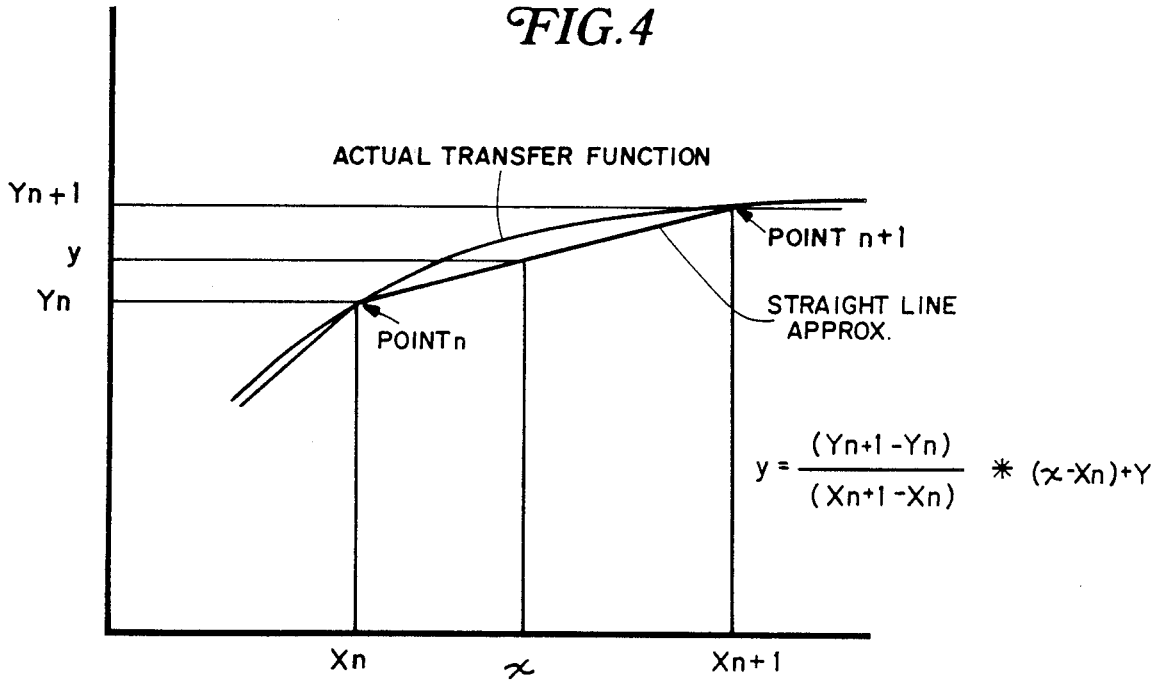
FIG. 4 is a graphical illustration of interpolation along line segments performed by the exemplary integrator shown in FIG. 3.

In this embodiment, a linear mass air flow signal is, in effect, obtained by storing and referencing the end points of straight line segments approximating the MAFS 14 transfer function (as corrected for by any additional non-linearities introduced by A/D converter 20). Only line segment end points are stored in the look-up table and referenced, since the A/D conversion process performed by A/D converter 20 inherently discards input information between the end points and automatically approximates to the closest end point. FIG. 4 shows how intermediate points are effectively interpolated along line segments by the A/D conversion and look-up process.

Integrator 24 receives the linearized digital air flow signal provided by linear function block 22 and may derive from that signal a mass air flow value integrated with respect to engine position, time, or both. In the preferred embodiment, integrator 24 may be a microprocessor or other digital processor (e.g., a PERI64); or it may be a time shared portion of another processor, e.g., the processor within engine management unit 28. Integrator 24 is appropriately programmed to perform a desired integration function.

In one embodiment, integration is performed at fixed engine positions as indicated by the "position" signal provided by engine 12. For example, each time the engine crankshaft rotates by a predetermined angle such as one degree of engine rotation, integrator 24 may sum linearized air mass. Integrator 24 may thus perform the following calculation:

$$(Y * n) = \sum_{(i=0)}^{(n-1)} Y_i$$

where Y is the average mass air flow during a cylinder event, $Y_i$ is the linear mass air flow sample, and n is the number of samples for each cylinder event and is equal to the total number of samples for a complete engine cycle divided by the number of cylinders the engine has.

Since n is a fixed number of a particular engine system 10 design, it can be considered a scaling factor of the average mass air flow. For the example of one (1) degree sample rate and four (4) engine cylinders, after each 180 degrees of rotation the average mass air flow rate may be presented to engine management unit 28 and a new average may then be accumulated.

In another embodiment, integrator 24 may integrate the linearized mass air flow signal with respect to time for one cylinder event to obtain the cylinder air "charge" (i.e., the trapped mass of air within the combustion chamber just after the intake valve closes). An exemplary equation for simple rectangle integration is:

$$Y = \sum_{(i=0)}^{(n-1)} X_i * t_i$$

where Y is the air mass, $X_i$ is the linearized mass air flow sample, and $t_i$ is the sample time interval.

FIG. 5 shows an exemplary graphical interpretation for the equation set forth above. In the preferred embodiment, the time period between samples is preferably fixed as determined by real time clock 26 (although the calculation could just as easily be implemented if desired to provide different time intervals between samples such that $t_0 \neq t_1 \neq t_2 \ldots$).

The calculated trapped air mass can be used as a "load factor" of the engine to provide similar results as may be obtained by measuring and using intake manifold pressure—this eliminating the need to measure intake manifold pressure directly. This calculated load factor is automatically compensated for the volumetric efficiency of the engine.

A special case of mass air flow integration with respect to time particularly useful if engine 12 has fixed valve timing is where a synchronous mass air flow sample is taken for each cylinder event and is then multiplied by the period of the cylinder event. This engine load factor can be very useful in engine control algorithms where the load factor and engine speed are used to index a three dimensional look-up table to determine an operating parameter such as fuel schedule or spark advance. FIG. 6 shows a typical three-dimensional plot corresponding to fuel correction factors developed by referencing such a look-up table. A conventional approach uses similar three-dimensional look-up tables with manifold pressure and engine speed as independent variables for the look-up.

Figure 7:
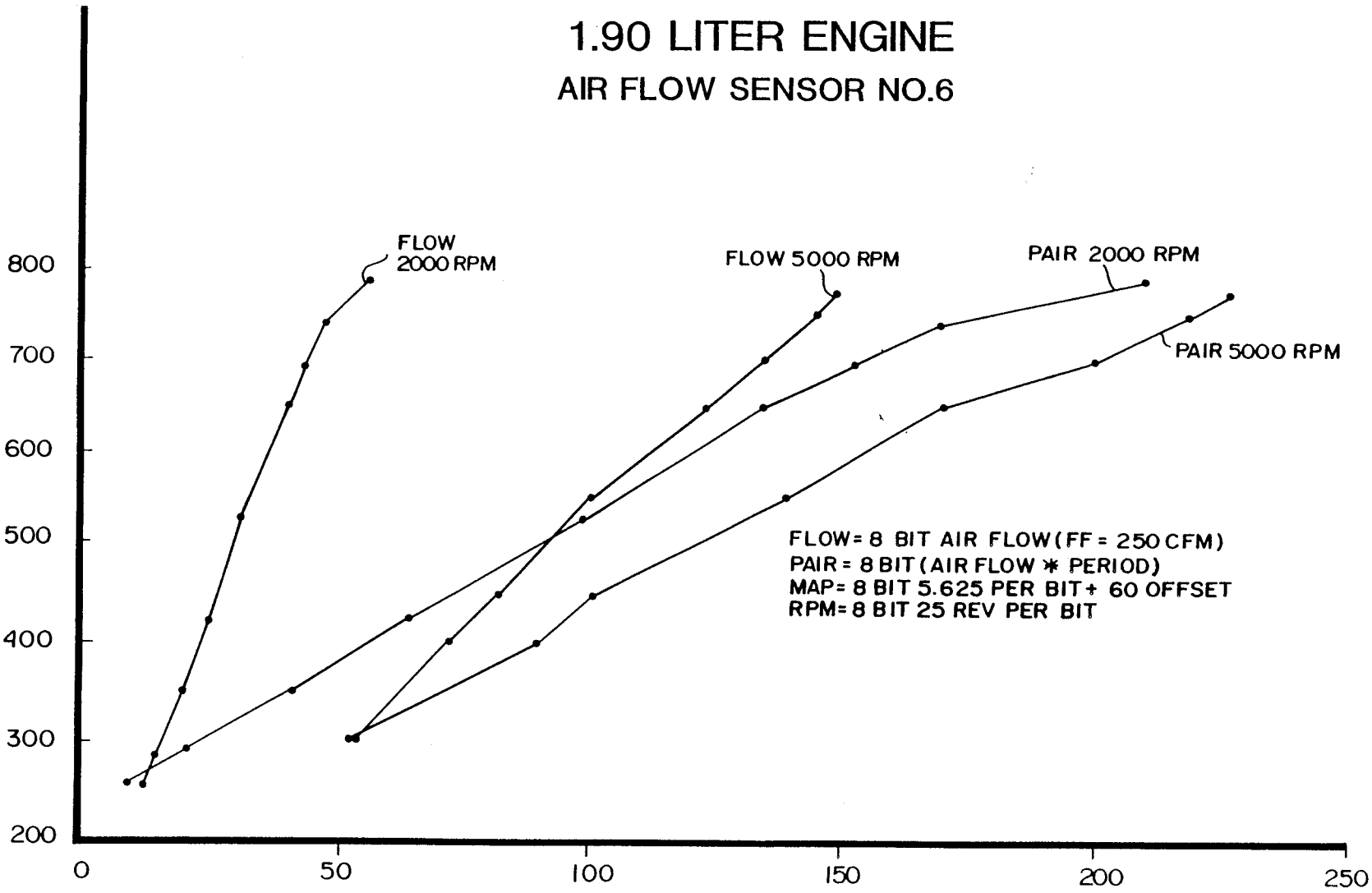
FIGS. 7 and 8 are graphical illustrations of actual measured test results provided by a preferred embodiment.
Figure 8:
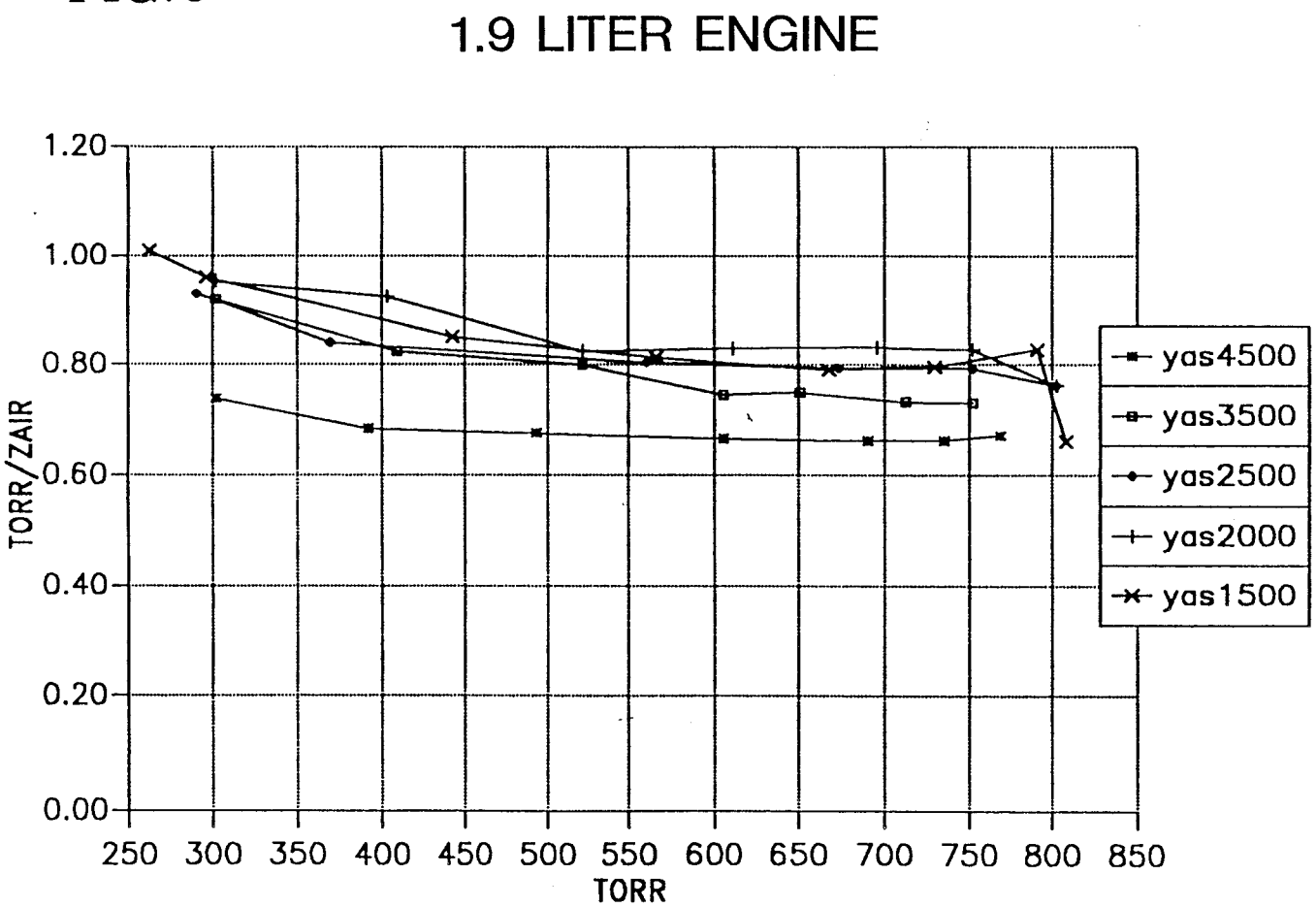

FIGS. 7 and 8 are graphical illustrations of actual experimental results obtained with an exemplary test engine system 10 of the type shown in FIG. 3 wherein engine 12 was a 1.9 liter engine. FIG. 7 plots air (vacuum) pressure in Torr versus numerical values for both linearized mass air flow ("flow") and integrated mass air flow ("PAIR") for two different engine speeds: 2000 rpm and 5000 rpm. Mass air flow from MAFS 14 was converted into an 8-bit digital value (FF hex=250 cfm) by A/D converter 20 and linearized using a look-up table (wherein each entry of the table comprised an 8-bit value with a weighting of 5.625 per bit+60 offset corresponding to the particular MAFS 14 used). This value was then integrated into the 8-bit values shown plotted and labelled "PAIR". Engine speed was measured and converted to an 8-bit value using a conventional speed sensing arrangement in which each bit is weighted to 25 rpm. FIG. 8 is a similar plot of experimentally measured pressure (Torr) versus (linearized) mass air flow (Torr/second or other time period) for five different engine speeds in rpm: 1500, 2000, 2500, 3500 and 4500.

Figure 9:
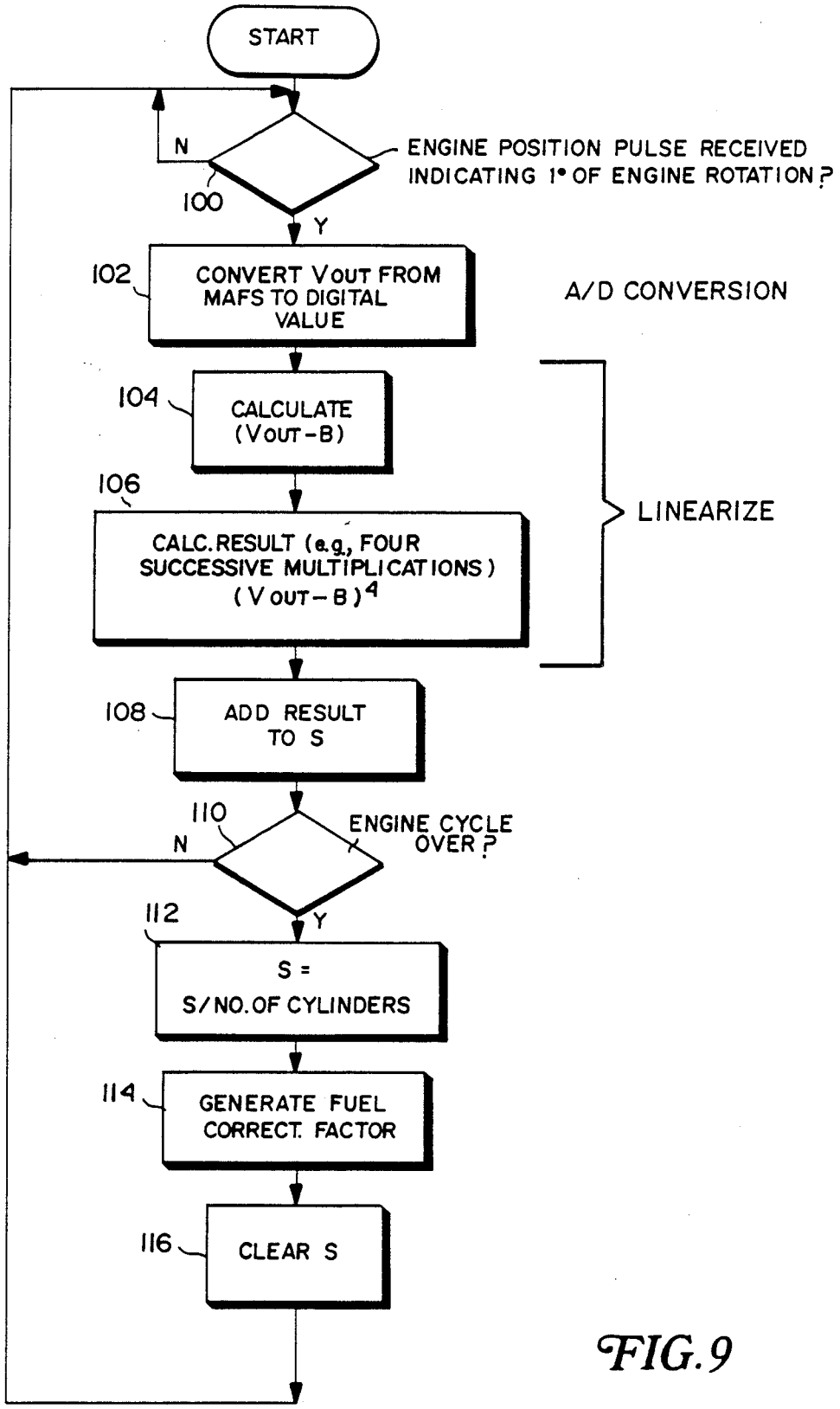
FIG. 9 is a schematic flowchart of exemplary program control steps performed by a microprocessor-based electronic engine control system in the preferred embodiment so as to calculate engine "load factor" and use such a calculated value to control an internal combustion engine.

FIG. 9 is a flowchart of exemplary program control steps performed by a microcontroller or other digital signal processor in accordance with the preferred embodiment of the present invention. A/D converter 20 may be controlled to sample the output $V_{out}$ of MAFS 14 upon each occurrence of a pulse from engine 12 representing 1 degree of engine crankshaft rotation (block 102). An appropriately programmed digital signal processor may then linearize the digital output of A/D converter 20 using the calculation mentioned above (block 104,106)—as alternatively, the digital output may be linearized as described using a look-up process. The linearized output may then be summed (added) into a temporary storage location S (block 108).

It is then determined whether the engine event cycle of interest is over (block 110). For example, it may be determined whether the engine 12 crankshaft has rotated 720 degrees (corresponding to one complete engine cycle) or an appropriate angle corresponding to a cylinder event (e.g., 180° for a 4-cylinder engine. If the engine cycle of interest is not yet completed, blocks 100–108 are repeated for each degree at crankshaft rotation until the engine cycle is completed.

The summed value S may then be further processed to provide integrated mass air flow for a desired engine event. In the example shown, S may be acquired over 720 degrees of crankshaft rotation and then divided by the number of cylinders of engine 12 to provide on average "load factor"—the amount of air trapped within each cylinder at the end of the cylinder intake stroke (block 112). Engine management unit 28 may then calculate a fuel correction factor (and/or other engine control parameters) based on this processed value S (block 114) using conventional three-dimensional analysis (in conjunction with measured engine RPM) if desired. The temporary storage location S is cleared in preparation for the next engine cycle (block 116) and blocks 100–116 are repeated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mass air flow metering system of the type responsive to the mass of air flowing into an internal combustion engine, said metering system comprising:

a mass air flow sensor providing an output signal $V_{out}$ responsive to mass air flow;

an analog to digital converter connected to receive said output signal $V_{out}$ which produces a first digital signal corresponding to said output signal $V_{out}$; and linearizing means connected to receive said first digital signal for mapping said digital signal into a further digital signal substantially linearly related to said mass of air flowing into said internal combustion engine, said linearizing means providing said further digital signal at an output thereof.

2. A system as in claim 1 wherein said linearizing means includes a memory storing a plurality of predetermined digital linearizing values, and means for selecting one of said plurality of linearizing values stored in said memory in response to said first digital signal.

3. A system as in claim 1 wherein said linearizing means comprises a digital signal processor preprogrammed to provide a fourth order calculation in response to said first digital signal.

4. A system as in claim 1 wherein:

said analog to digital converter comprises a non-linear A/D converter introducing additional non-linearity into said first digital signal; and said linearizing means includes means for storing at least one predetermined mapping linearizing value which accounts for non-linearity of said mass air flow sensor and the additional non-linearity introduced by said non-linear A/D converter.

5. A system as in claim 1 wherein:

said analog to digital converter includes plural A/D converters connected in parallel; and said system further includes means for selecting between said plural A/D converters based on the magnitude of said signal $V_{out}$.

6. A system as in claim 1 further including integrating means connected to receive said further digital value for integrating said further digital value over time.

7. A system as in claim 1 wherein:

said engine includes at least one rotating member; and said system further includes integrating means connected to receive said further digital value for integrating said further digital value over a predetermined change in the angular position of said rotating member.

8. An internal combustion engine control system of the type which controls at least one parameter of an internal combustion engine, said engine exhibiting a characteristic engine event, said control system comprising:

a non-linear mass air flow sensor providing an output signal $V_{out}$ responsive to the mass of air flowing into said internal combustion engine;

means connected to receive said output signal $V_{out}$ for continually sampling said output signal $V_{out}$ and for producing a series of first values responsive to said sampled output signal $V_{out}$;

linearizing means connected to receive said series of first values for converting said first values into further values, said further values being substantially linearly related to said mass of air flowing into said internal combustion engine, said linearizing means including means for applying a fourth order transfer function to said first values so as to obtain said further values;

integrating means for integrating said further digital values over the occurrence of said engine event to provide an integrated value; and engine management means for controlling said engine parameter in response to said integrated value.

9. An internal combustion engine control system of the type which controls at least one parameter of an internal combustion engine, said engine exhibiting at least one engine event, said control system comprising:

a non-linear mass air flow sensor providing an analog output signal $V_{out}$ related by a fourth order transfer function to mass air flow into said internal combustion engine;

analog to digital converter means connected to receive said output signal $V_{out}$ for continually sampling said output signal $V_{out}$ and for producing a series of first digital values responsive to said sampled output signal $V_{out}$;

linearizing means connected to receive said series of first digital values for approximating said output signal $V_{out}$ with further digital values being substantially linearly related to said mass of air flowing into said internal combustion engine in accordance with predetermined information corresponding to the characteristics of said mass air flow sensor;

integrating means for integrating said further digital values over the occurrence of said engine event to provide a load factor value; and engine management means for controlling said engine parameter in response to said load factor value.

10. A system as in claim 9 wherein said linearizing means includes mapping means connected to receive said first series of digital values, said mapping means selecting one of plural individual discrete predetermined values in response to said digital values applied thereto.

11. A system as in claim 10 wherein said mapping means selects one of said predetermined values for each of said digital values received thereby.

12. A system as in claim 9 wherein said integrating means comprises means for integrating said further digital values over a predetermined time period.

13. A system as in claim 9 wherein:

said internal combustion engine is of the type having at least one cylinder and which repetitively performs a predetermined sequence of cylinder events corresponding to said cylinder;

said system further comprises further sensor means coupled to said engine for determining the beginning and the end of one of said cylinder events; and said integrating means comprises means for acquiring and integrating said further digital values occurring between the beginning and the end of said one cylinder event so as to generate said load factor corresponding to the mass of air changing said cylinder.

14. A system as in claim 9 wherein:

said internal combustion engine has at least one combustion chamber and means for drawing air into and trapping said drawn air within said combustion chamber during a predetermined intake stroke associated with said one combustion chamber;

said system further comprises further sensor means coupled to said engine for determining the beginning and the end of an engine event including said predetermined intake stroke; and said integrating means is responsive to said determination of said further sensor means and includes means for acquiring and integrating said further digital values occurring during said engine event so as to generate said load factor value, said load factor value representing the mass of air trapped within said one combustion chamber at the conclusion of said intake stroke.

15. A system as in claim 9 wherein said engine management means includes means for sealing said load factor value by the number of cylinders of said engine.

16. A method of controlling at least one parameter of an internal combustion engine, said engine exhibiting a cylinder event corresponding to an engine cylinder, said method comprising the following steps:

(a) generating a signal $V_{out}$ responsive to the mass of air flowing into said internal combustion engine;

(b) sensing the angular position of a rotatable member of said engine;

(c) determining the occurrence of said cylinder event in response to said sensed angular position;

(d) sampling said output signal $V_{out}$ in response to said occurrence sensed by said determining step (c);

(e) converting said sampled value into a linearized value substantially linearly related to said mass of air flowing into said internal combustion engine during said cylinder event;

(f) multiplying said linearized value by the time duration of said cylinder event so as to obtain an engine load value; and (g) controlling said engine parameter in response to said engine load value.

17. A method as in claim 16 wherein said controlling step (g) includes the step of generating a fuel correction value.

18. A method as in claim 16 wherein:

said method further includes the steps of determining the speed of rotation of said rotatable member and driving said cylinder event time duration in response to said determined speed; and said controlling step includes the step of controlling said engine parameter in response to said speed and said engine load value.

19. A method as in claim 16 wherein said controlling step comprises controlling engine ignition spark advance in response to predetermined values stored in a three-dimensional look-up table.

20. A method as in claim 16 wherein said controlling step comprises controlling engine fuel delivery in response to predetermined values stored in a three-dimensional look-up table.

21. A method as in claim 16 wherein said converting step includes applying a fourth order transfer function to said sampled value so as to obtain said linearized value.

* * * * *